US009671188B2

(12) United States Patent
Sellars

(10) Patent No.: US 9,671,188 B2
(45) Date of Patent: Jun. 6, 2017

(54) RIFLE ACCURACY AND NOISE SUPPRESSION SYSTEMS

(71) Applicant: Timothy Sellars, North Richland Hills, TX (US)

(72) Inventor: Timothy Sellars, North Richland Hills, TX (US)

( * ) Notice: Subject to any disclaimer, the term of this patent is extended or adjusted under 35 U.S.C. 154(b) by 0 days.

(21) Appl. No.: 14/265,631

(22) Filed: Apr. 30, 2014

(65) Prior Publication Data

US 2015/0267986 A1 Sep. 24, 2015

Related U.S. Application Data

(60) Provisional application No. 61/862,288, filed on Aug. 5, 2013.

(51) Int. Cl.
*F41A 21/30* (2006.01)
*F41A 21/48* (2006.01)
(Continued)

(52) U.S. Cl.
CPC ..... *F41A 21/30* (2013.01); *F41A 3/64* (2013.01); *F41A 3/66* (2013.01); *F41A 21/48* (2013.01); *F41A 21/485* (2013.01); *F41C 23/00* (2013.01)

(58) Field of Classification Search
CPC ..... F41A 21/30; F41A 21/32; F41A 21/34; F41A 21/36; F41A 21/00
(Continued)

(56) References Cited

U.S. PATENT DOCUMENTS 2,765,706 A * 10/1956 Strohl ..... F41A 21/36 89/14.3
2,883,781 A * 4/1959 Harvey ..... F41A 21/34 42/105
(Continued)

OTHER PUBLICATIONS

White, Mark, "The Use of Sound Suppressors on High-Powered Rifles", Article from GunWriters, Feb. 2, 2000, pp. 1-15, USA guns.connect.fi/gow/highpow.html.
(Continued)

*Primary Examiner* — Jonathan C Weber
(74) *Attorney, Agent, or Firm* — Whitaker Chalk Swindle & Schwartz PLLC; Charles D. Gunter, Jr.

(57) ABSTRACT

A noise suppressor for mounting on a distal end of a rifle barrel. The suppressor is made up of an inner core component and an outer sleeve component which is received about the inner core component, creating a gas-receiving chamber between the two. The inner core component an internally threaded, barrel receiving end which receives and engages the exteriorly threaded end of the rifle barrel in overlapping fashion, an oppositely arranged exteriorly threaded end, and a central bore between the two ends which allows the passage of a bullet when the bullet is fired, firing of the bullet also setting off hot exhaust gases in the central bore. The inner core component has window openings for exhausting hot gases from the inner chamber into the surrounding outer chamber and also has an exterior longitudinal region forward of the central chamber, the exterior region having a series of longitudinally aligned, upwardly extending teeth formed therein for diverting the hot, high speed gases contacting the upwardly extending teeth.

18 Claims, 7 Drawing Sheets

(51) Int. Cl.
*F41A 3/64* (2006.01)
*F41A 3/66* (2006.01)
*F41C 23/00* (2006.01)

(58) Field of Classification Search
USPC ..... 89/14.2, 14.3, 14.4; 181/223; 42/77
See application file for complete search history.

(56) References Cited

U.S. PATENT DOCUMENTS 5,279,200 A * 1/1994 Rose ..... F41A 21/32 42/97
5,698,810 A * 12/1997 Rose ..... F41C 27/22 42/97
7,237,467 B1 * 7/2007 Melton ..... F41A 21/30 89/14.4
7,587,969 B2 * 9/2009 Silvers ..... F41A 21/34 181/223
7,600,606 B2 * 10/2009 Brittingham ..... F41A 21/30 181/223
8,096,222 B2 * 1/2012 Silvers ..... F41A 21/30 181/223
8,104,570 B2 * 1/2012 Miller ..... F41A 21/30 181/223
8,511,425 B2 * 8/2013 Larue ..... F41A 21/30 181/223
8,739,922 B2 * 6/2014 Wirth ..... F41A 21/30 181/223
8,950,310 B2 * 2/2015 Storrs ..... F01N 3/02 181/223
2007/0107590 A1 * 5/2007 Silvers ..... F41A 21/30 89/14.4
2010/0229712 A1 * 9/2010 Graham ..... F41A 21/34 89/14.2

OTHER PUBLICATIONS

Kolbe, Geoffrey, "The Vibrations of a Barrel Tuned for Positive Compensation," Article, Rimfire Accuracy Research Program, Jul. 9, 2011, updated Oct. 20, 2011, pp. 1-8, USA www.geoffrey-kolbe.com/articles/rimfire-test.htm.

* cited by examiner

RIFLE ACCURACY AND NOISE SUPPRESSION SYSTEMS

A. CROSS REFERENCE TO RELATED APPLICATIONS

The present application claims priority from a previously filed provisional application, Ser. No. 61/862,288, filed Aug. 5, 2013, entitled "Method of Improving Rifle Accuracy", by the same inventor.

BACKGROUND OF THE INVENTION

B. Field of the Invention:

The present invention relates generally to rifle accuracy and, more particularly, to a method for improving the accuracy of rifles when shooting at a fixed distance, using varying velocity ammunition and when shooting in differing atmospheric conditions. In another aspect, the invention relates to a noise suppressor design for such a rifle.

C. Description of the Prior Art

There has always been a desire among marksmen for firearms to be as accurate and consistent as possible during firing. This desire is particularly characteristic of marksmen who engage in rifle target shooting competitions and so-called "bench rest" competitions. As a result, the prior art is replete with efforts to eliminate or at least minimize those factors that adversely affect rifle accuracy. Two factors which have been studied extensively in the past are: (1) the barrel vibration which occurs upon firing of the weapon; and (2) the recoil which the marksman absorbs upon firing the weapon. Attempts to eliminate or control barrel vibration and recoil have involved a variety of materials and techniques. For example, various types and kinds of bedding materials have been used as a shock absorber and dampener between the barrel and the action assemblies and stocks of a rifle. The kinds and positioning of mounting screws associated with the components of a rifle have been examined. Different stock and barrel configurations have been tried in the past.

Muzzle brakes are another type accessory which have been used in the past with rifles in an attempt to lessen the effects of recoil and thus improve accuracy. The known muzzle brakes function to exhaust propulsion gases as a means of reducing recoil and of dissipating propulsion gases in a direction or directions other than directly out the muzzle of the barrel.

Another approach to improving rifle accuracy has involved attaching a weight to the end of the muzzle as a means of dampening barrel vibrations set in motion by the discharge of the firearm. U.S. Pat. No. 4,726,280, for example, discloses a technique for improving rifle accuracy by mounting a muzzle member on the muzzle end of a gun barrel. RE. 35,381 describes the Browning BOSS™ ballistic optimizing system which uses a movable weight element secured to the muzzle end of a rifle barrel. The weight element can be moved axially along the muzzle region of the barrel to change the effective weight applied for vibration dampening purposes.

U.S. Pat. No. 5,423,145 describes a rifle barrel harmonic vibration tuning device in which a "contact means" is adjustably positionable along the underside of the rifle barrel. The contact means exerts a variable amount of pressure between the rifle stock and its barrel at any of a number of given position along the barrel in an attempt to control the barrel's harmonic vibrations. U.S. Pat. No. 3,340,641 is similar in its disclosure and shows another sliding contact member which is used in an attempt to control the harmonic vibrations of the rifle barrel.

Despite these various types of efforts, deficiencies continue to exist in achieving ultimate rifle accuracy. This is particularly true when firing of certain factory loaded cartridges with a barrel not designed specifically for use with that cartridge. For example, with a lower velocity ammunition, the bullet tends to leave the barrel later than a faster velocity ammunition. As a result, due to the force of recoil, the bullet exits the muzzle at a point at which the rifle barrel has risen upwards more than it would with the faster velocity ammunition. The bullet shot from the lower velocity ammunition will thus tend to strike the target higher than the higher velocity ammunition, at a certain fixed distance.

A need exists, therefore, for a method for improving rifle accuracy which could be "tuned" to compensate for ammunition of varying velocities, particularly when shooting at a fixed distance. This would be advantageous, for example, in bench rest competitions and in certain military situations.

While there are many "tuners" on the market today, the tuning achieved or converging of different velocities is only effective out to about 100 yards. It is not possible to completely converge different velocities at long ranges out to extreme ranges, e.g. 1000 yards, or more.

There is also a need in the arena of tactical firearms that are utilized by the military as well as law enforcement tactical and special operations personnel for military and law enforcement activities, to provide a noise suppressor for such weapons. Noise suppressors are also used in some civilian circumstances, as well, as will be explained.

As is well known who are familiar with and enjoy firearms, firearms create both a loud noise as well as a significant recoil when they are discharged. The noise and the recoil are generally proportional to the size of the bullets being discharged by the firearms. For example, a 22 caliber rifle produces less noise and recoil than does a high caliber hunting rifle such as a 30-06 caliber firearm. However, both large and small bore weapons generally produce an undesirably great noise and recoil when discharged. This is true with respect to almost all firearms including both rifles and pistols.

Noise suppressors, sometimes referred to as "silencers' for firearms have been proposed and made for many decades. Noise suppressors are very popular on varmint rifles because one shot drives varmints underground for hours while noise suppressed rifles can be fired many times before the game becomes wary. The standard noise suppressor was originally proposed by Hiram Maxim and present commercially available silencers are manifest descendants. These suppressors are mounted on the muzzle end of a firearm so the round or shot and all propellant gases pass through the suppressor. Most present day suppressor designs are basically mufflers. Disclosures of these typical firearm noise suppressors are found in U.S. Pat. Nos. 916,885; 958,934; 958,935; 1,229,675; 2,449,571; and 3,713,362.

Rifle suppressors are typically threaded onto the outer end of a firearm barrel in order to reduce the noise of the firearm. These devices generally work to muffle or reduce the noise of the exhausting gases created by ignition of a cartridge without necessarily retarding the passage of the bullet through the gun barrel. In certain of the prior art designs, the noise suppressor is designed to effect rapid cooling of exhausting gases and the reduction of pressure therefrom before the gases emerge from the end of the noise suppressor device. Typically, the well-known noise suppressors have a large cross-sectional area providing a chamber through which a bullet passes that contains heat absorbing and/or exhaust gas-defusing materials.

Although most noise suppressors are large diameter cylindrical devices that are screwed onto the end of a firearm barrel, it is also known to provide a noise suppressor or silencer along the entire length of an enlarged-diameter rifle barrel.

While there have been a number of advances in art of firearms suppressors, there continues to be a need for improvement. For example, many of the present suppressor designs are large and bulky, making them awkward to handle, especially in tight quarters. Some have wearable components such as baffles and O-rings which wear over time. Many of the present designs fail to offer a self-cleaning feature.

SUMMARY OF THE INVENTION

The method of the present invention is directed toward increasing the shooting accuracy achievable with rifles, and particularly when shooting a rifle at a given, fixed distance using ammunition of varying velocity, or under varying atmospheric conditions. By this means, it becomes possible to "match" the rifle to a particular ammunition. Thus, it is unnecessary to select a cartridge based upon the inherent responses of a particular rifle or the necessity of having the rifle barrel matched to a particular brand and/or velocity of ammunition. Accordingly, factory loaded ammunition can be shot at even very great distances with accuracies heretofore unobtainable, Moreover, different factory loaded cartridges can be fired accurately from the same rifle by merely making appropriate system adjustments.

The method of the invention thus provides a method of increasing rifle accuracy by converging bullet velocity to a given distance. To accomplish this purpose, a rifle is first provided with a stock having a butt section and a forearm section with a stock recess, an action/receiver with a front face and a rear face, a vertically depending recoil lug attached to the front face of the action and a one piece barrel having a barrel shoulder at one end which extends outwardly from the recoil lug and which has a distal, muzzle end. The barrel is mounted in free-floating fashion within the stock recess so that the barrel extends from the recoil lug and rifle action and so that nothing is touching between the stock and the barrel forward of the recoil lug. The rifle action is extended with a tensioning bar which is welded to the recoil lug, the tensioning bar extending in a generally horizontal plane outwardly from the recoil lug in the direction of the barrel. The rifle is also provided with an adjustment knob which extends vertically downward from the rifle forearm at one extent and which contacts the tensioning bar at an opposite extent. The adjustment knob can be adjusted between minimum and maximum positions, the maximum position serving to restrict the tendency of the action to lift up out of the stock recess under recoil.

The barrel is designed with certain specified characteristics. The barrel has a solid bull muzzle end with a recessed crown, the barrel weight which exists in front of the recessed crown being in tune for one specific distance only. Preferably, the barrel is cut to a specific length and muzzle weighted to tune the barrel to the longest expected shooting distance which is expected to be encountered. The barrel has a narrowed mid-section which produces an increased, "whippy" vertical bending action under recoil and a thus a wider tune spectrum on the vertical upswing of the barrel under recoil.

The tensioning bar and adjustment knob are incrementally adjusted to vary any muzzle weighted effect produced by the barrel design when shooting at shorter distances or when there is a velocity variance in the ammunition being used in the rifle. In a preferred embodiment of the invention, adjusting the tension on the tensioning bar with the adjustment knob between minimum and maximum positions acts to restrict movement of the action and, in turn, upward force on the barrel acting to lift the barrel upward from the stock recess, thereby reducing vertical whipping action of the barrel at shorter shooting distances or to compensate for variances in ammunition velocity. The barrel design, along with the tensioning bar and adjustment knob provide infinite tuning accuracy with varying velocity ammunition and in varying atmospheric conditions.

A novel noise suppressor design is also shown. The noise suppressor can be used with the previously described, highly accurate rifle, or with other rifle designs where the rifle has a barrel at a breach end, the barrel also having an externally threaded, distal end. The noise compressor has an inner core component and an outer sleeve component, the outer sleeve component being closely received about the inner core component in use. The inner core component is a one piece design, preferably formed of a single piece of metal.

The inner core component has an internally threaded, barrel receiving end which receives and engages the exteriorly threaded end of the rifle barrel in overlapping fashion, an oppositely arranged exteriorly threaded end, and a central bore between the two ends which allows the passage of a bullet when the bullet is fired, firing of the bullet also setting off hot exhaust gases in the central bore. The sleeve component forms a surrounding outer chamber between the sleeve component and the inner core component when in place on the inner core component. The inner core component also has an inner chamber with at least one pair of oppositely facing window openings for exhausting gases from the inner chamber into the surrounding outer chamber. The inner core component also has an exterior longitudinal region forward of the central chamber, the exterior region having a series of longitudinally aligned, upwardly extending teeth formed therein for reducing the velocity of the hot gases contacting the upwardly extending teeth.

Preferably, the longitudinally aligned teeth on the longitudinal region of the suppressor define a series of teeth crests separated by a series of troughs and the rests of the longitudinally aligned teeth are inclined slightly in the direction of the central chamber and the direction of the hot gases being exhausted therein.

In the preferred design, the central chamber has a rearward bore region which extends in the direction of a corresponding bore region in the rifle barrel, so that a bullet exiting the rifle barrel at least partly enters the rearward bore region before completely exiting the rifle bore region. The central chamber, in addition to the pair of oppositely arranged window openings, also preferably has a pair of top and bottom openings for exhausting additional gases from the central chamber.

The internally threaded, barrel receiving end of the inner core component which receives and engages the exteriorly threaded end of the rifle, together with the oppositely arranged exteriorly threaded end, together provide a two-point mount for the noise suppressor on the rifle barrel. A threaded cap is preferably provided which engages the exteriorly threaded end of the inner core component to complete the two-point mount. In one preferred form of the invention, the threaded end cap has an internal bevel which matches the contour of an external bevel provided on outer sleeve when the threaded end cap is engaged with the exteriorly threaded end of the inner core component.

When the noise suppressor of the invention is used with the highly accurate rifle design of the invention, the noise suppressor adds weight forward of the crown of the rifle muzzle, the added weight being proportional to a desired tuning effect at a longest expected shooting distance, for positively compensating the rifle for slower bullet velocities.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
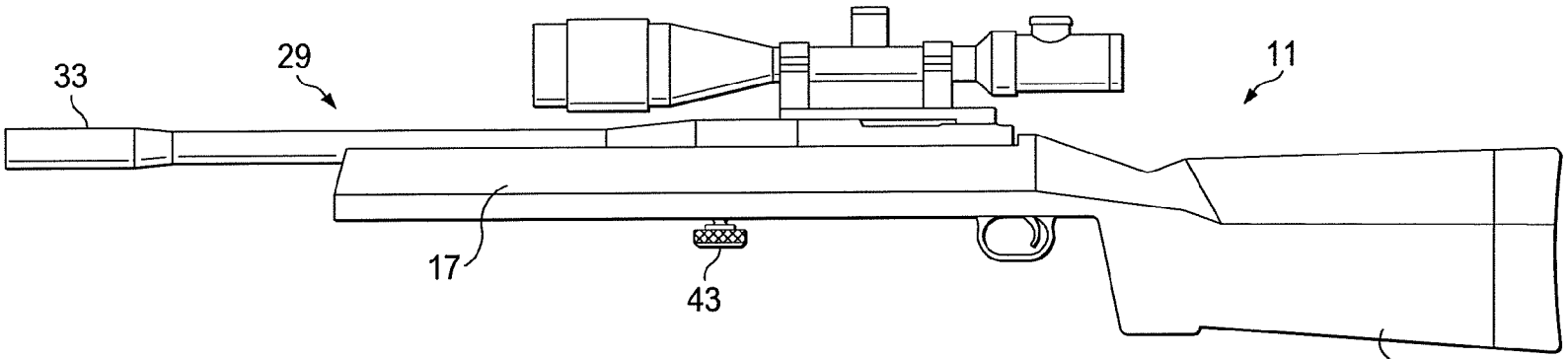
FIG. 1 is a side view of a rifle which has been designed according to the principles of the invention.

Rifle Accuracy System:

In a first aspect, the present invention deals with a rifle accuracy system which will now be described. Turning to FIG. 1, there is shown a rifle 11 which has been designed in accordance with the principles of the present invention. The rifle 11 is designed with "positive compensation" characteristics so that rifle accuracy can be increased by converging bullet velocity to a given, fixed distance. In other words, so that it is distance dependent. The positive compensation can be limited depending upon the given yardage to the target. The rifle does not have to be provided by a particular manufacturer and the principles of the invention can be applied to rifles of various makes and calibers.

The concept of "positive compensation" is based on the fact that when any given batch or type of ammunition is chronographed, there is a always a spread in muzzle velocity observed about a mean. As a consequence, there will be a vertical dispersion in the fall of shot at the target due to the fact that the slower bullets in the sample take longer to travel down the range and so drop further than the faster bullets. The expected vertical dispersion can be calculated for a given batch of ammunition due to the observed spread in muzzle velocity.

However, it is often observed that the calculated vertical dispersion is not evident on the target, at least at certain distances The concept of "positive compensation" can be used to explain this result. It is generally recognized that the shock of the recoil forces in the rifle generate up and down vibrations in the barrel. For positive compensation, it is envisaged that the bullet is exiting the muzzle during an upward swing in the vibration at the muzzle, such that faster bullets (which arrive at the muzzle slightly earlier than slow bullets) are launched at a slightly lower angle into their trajectory than slower bullets. This will tend to reduce the vertical dispersion in the group at the target resulting from the variation in muzzle velocity. If the upward swing in the muzzle is exactly right, there will be complete positive compensation as the trajectories of bullets across the entire spread of muzzle velocities all meet at the same height on the target at a given range Returning now to the description of the rifle of the invention, FIGS. 1 and 3 show a rifle 11 having a stock 13 and having a butt section 15 and a forearm section 17 with a stock recess 19. The rifle also has an action/receiver 21 with a front face 23 (see FIG. 2) and a rear face 25 (FIG. 3). A vertically depending recoil lug 27 is attached to the front face 23 of the action. A one piece barrel 29 having barrel shoulder (31 in FIG. 2) at one end extends outwardly from the recoil lug 27 and which has a distal, muzzle end 33. These general parts of the rifle design will be familiar to those skilled in the gun making arts.

As has been briefly described, when the rifle 11 is fired, the exiting bullet exerts an opposite, recoil force on the rifle action which is transmitted through the stock to the shooter's shoulder. The center of gravity of the rifle action is lower than the central axis of the rifle barrel. Thus, the force of recoil tends to act to lift the action upwardly from the stock. At the same time, the muzzle end of the barrel begins an upswing motion relative to its rest position. As previously mentioned, when shooting targets at a given distance, a slower velocity bullet will tend to exit the muzzle of the rifle when the rifle barrel is at a point further along on the upswing path of travel than would a faster velocity bullet. As a result, the slower bullet tends to strike the target at a higher relative position than a higher velocity bullet for a certain given distance.

The present invention has as its object to compensate for these variations in bullet velocity at a given distance, and also for the effects of atmospheric conditions such as temperature. However, it goes about this differently than the techniques popularized in the current state of the art. Instead of attempting to control "barrel harmonics" or vibrations, as with a sliding weight, Applicant intentionally provides a rifle design with a barrel having "whippy" recoil characteristics. These characteristics would be just the opposite of the designer of a rifle having some sort of harmonic vibration compensating mechanism. By harmonic vibration compensating mechanism, Applicant would refer the reader to the Browning BOSS® system described in RE 35,381 as discussed in Applicant's Background description.

Figure 2:
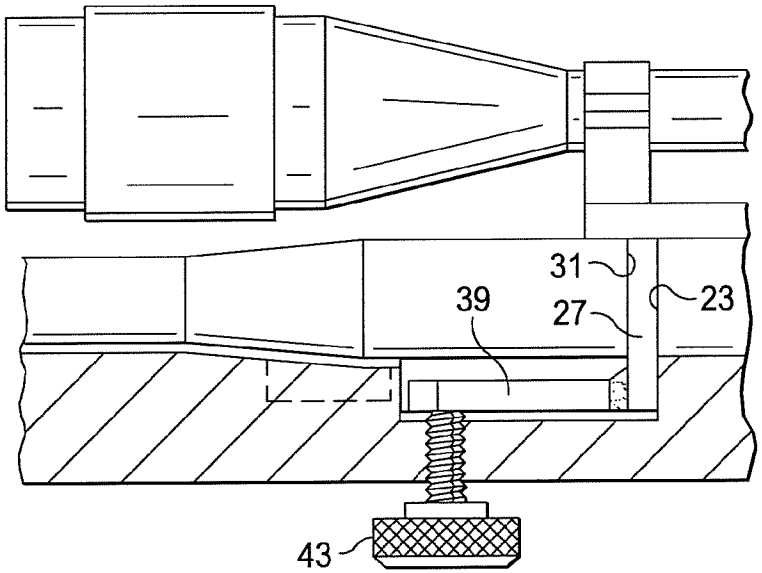
FIG. 2 is a partial sectional view of the rifle of FIG. 1, showing the tensioning bar which is welded to the front face of the recoil lug of the rifle.
Figure 3:
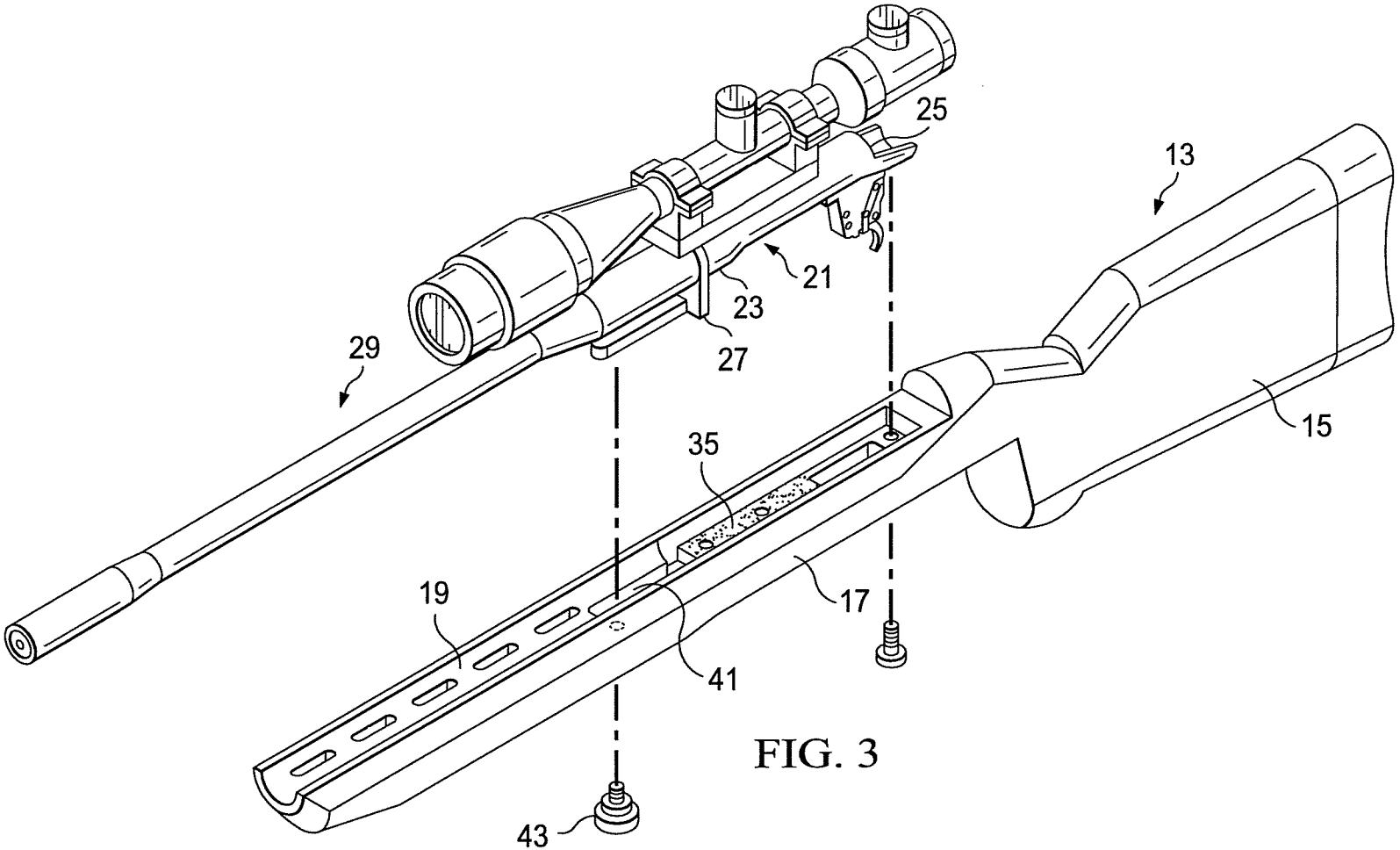
FIG. 3 is a perspective view of the rifle of FIG. 1 showing the action in exploded fashion.
Figure 4:
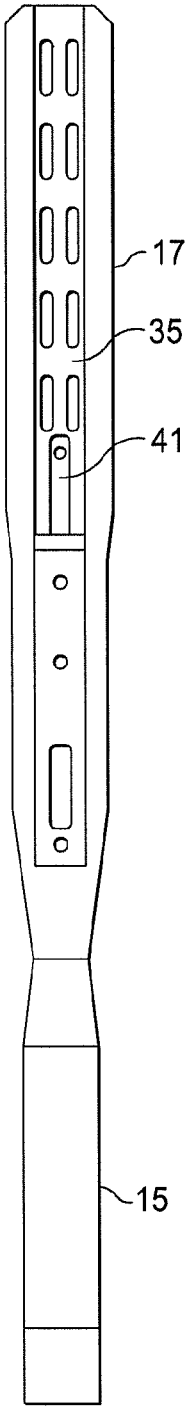
FIG. 4 is a top, isolated view of the rifle stock, showing the bedding in the stock.

In Applicant's design, the barrel 29 is mounted in "free-floating" fashion within the stock recess 19 so that the barrel extends from the recoil lug 27 and rifle action 21 and so that nothing touches between the stock and the barrel forward of the recoil lug (see FIG. 2). In the particular preferred design shown in FIGS. 3 and 4, the region of the stock beneath the action is "bedded" with a bedding material 35. The use of bedding is a known technique and it is well recognized that proper bedding will increase the accuracy of a rifle. Rifle bedding (also known as glass bedding) is the process of filling gaps between the action and the stock of a rifle with an epoxy based material. The bedding creates a stable and precise fit for the contact surfaces. Bedding is a technique employed in accurizing a rifle and to a lesser extent prolonging the life of the stock.

Bedding increases accuracy in part by relieving stress on the action. The rifle's action will rarely sit flush in the stock without bedding. This causes the action to flex when tightening the bolts holding the action to the stock. The flexing results in a loss of accuracy. Bedding will create a flush surface for the action and prevent flexing. Bedding also reduces movement of the action in the stock. Without bedding, the action may be more likely to shift after a shot. If the action shifts and does not return to same spot in the stock the rifle will lose the ability to maintain zero. Full contact bedding of the action, with the barrel floated, is thus a known method for long range rifles with a heavy barrel. A free-floating barrel will generally produce the greatest accuracy. In the case of the rifle of the invention, the rifle barrel thus floats within the stock recess and extends from the action/receiver.

With the bedding so positioned, it functions as a shock absorber. The actual bedding material can be chosen from a number of shock absorbing or stabilizing materials. For example, it may be a synthetic rubber or similarly resilient elastomeric material.

In the case of the Applicant's design, the barrel is a solid, one piece barrel which is cut to a specific length and muzzle weighted to tune the barrel to the longest expected shooting distance. For example, the barrel might be "tuned" to shoot groups at 1000 yards in bench rest competition. The desired "tuned" characteristics are achieved by providing the rifle with a barrel having a solid "bull", (enlarged) muzzle end 33 (FIG. 1), with a recessed crown (37 in FIGS. 3 and 5), and with a flexible or weakened mid-region ("m" in FIG. 5). The barrel weight which exists in front region of the barrel is in tune for one specific distance only, in this case 1000 yards.

Figure 5:
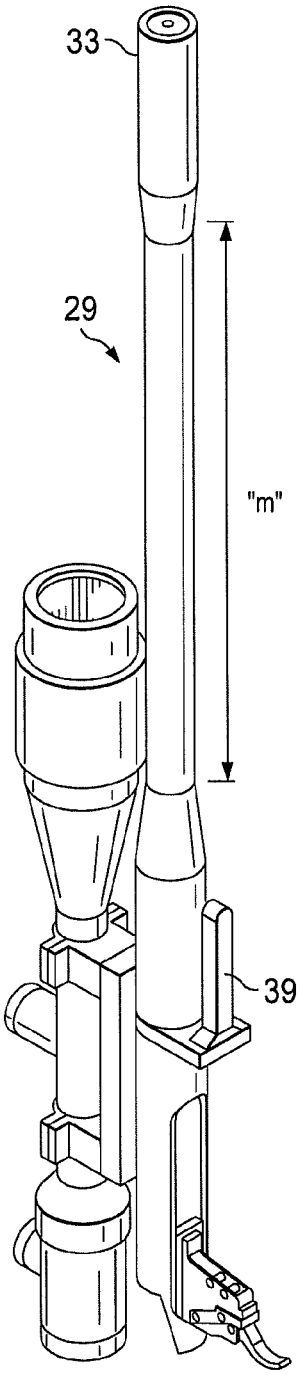
FIG. 5 is an isolated view of the rifle action, again showing the tensioning bar which is welded to the front face of the recoil lug of the rifle.

FIGS. 3 and 5 show the contours of the barrel's narrowed mid-section ("m" in FIG. 5) which produces an intentionally wider barrel upswing and an increased "whippy" vertical bending action and a thus a wider tune spectrum on the vertical upswing of the barrel under recoil. In the example shown, the narrowed mid-section has a diameter of approximately 0.925 inches as compared to the inner and outer ends of the barrel which each have a diameter of approximately 1.250 inches. The "whippy" action of the barrel, together with the weighted muzzle and recessed crown provide a type of "positive compensation" which is tuned for the one specific distance, in this case 1000 yards. The barrel is cut and weighted for the longest expected distance to be shot in, for example, a benchrest competition.

The amount of weight needed in the front (crown) region of the rifle barrel can be determined empirically by shooting at a given distance and gradually adding weight to the barrel until the bullets are hitting the same spot on the target. A different weight will be required for a different caliber rifle. For example, 5 ounces for a 6 mm Remington™, 10 ounces for a 7 mm and 11 ounces for a 30 caliber. A rimfire, being about a three times slower bullet, will require something on the order of 16 ounces of added weight forward of the barrel crown.

Figure 10:
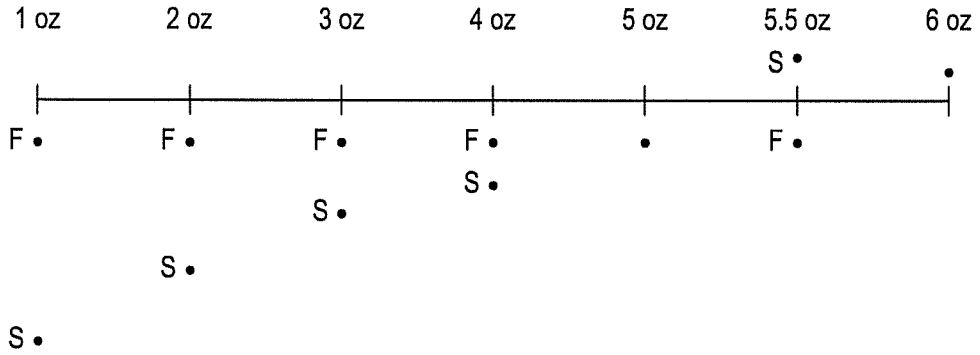
FIG. 10 is a chart showing the effect of added weight in front of the rifle crown region on convergence of a rifle bullet at a given distance.

Perhaps surprisingly, every gun converges at one spot only. This is illustrated, in simplified fashion, in FIG. 10 of the Drawings for 6 mm Remington™ ammunition at 100 yards:

Note the convergence at 5 ounces of weight in front of the recessed crown of the barrel. Every gun converges at 5, 10, 16, 24, etc. ounces, but there is only one point in which the slower round hits the target higher than the faster round, showing over (positive) compensation at 100 yards. This means that the bullets will necessarily converge at a longer distance. The reversion in the point of impact (POI) usually happens shortly after one of the convergence points of weighting, as is illustrated somewhat schematically in Chart I above.

Figure 6:
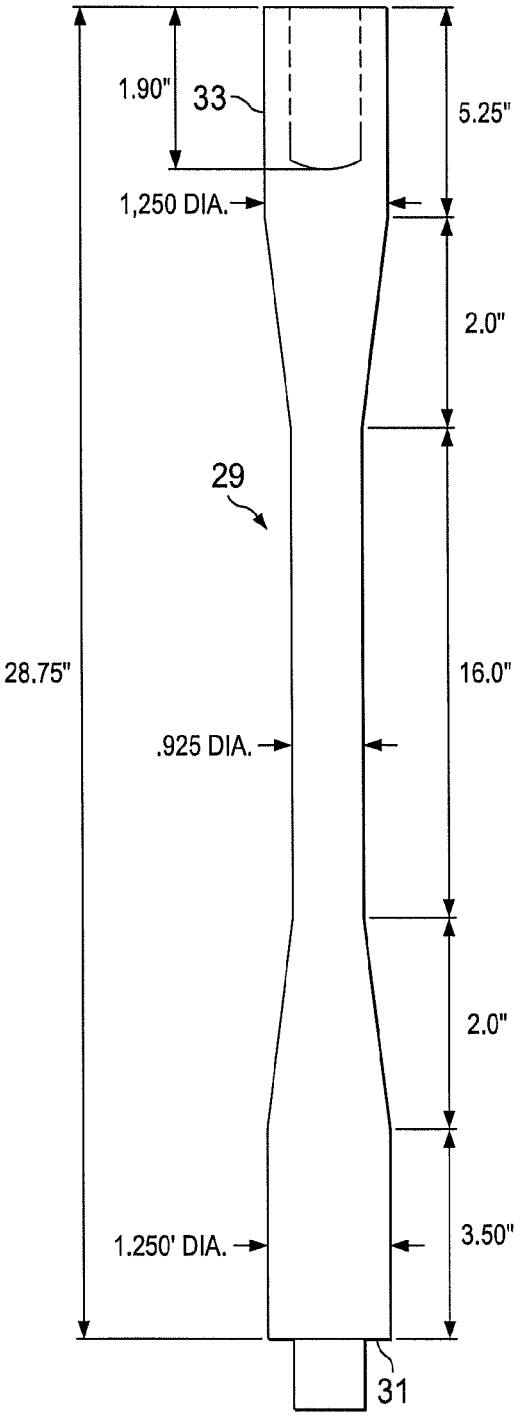
FIG. 6 is a schematic view of a rifle barrel designed according to the principles of the present invention, showing the exemplary dimensions thereof.

FIG. 6 shows a rifle barrel designed according to the principles of the invention, as described above, and showing actual representative barrel dimensions for a barrel designed to shoot at, for example 1000 yards.

With this barrel design and proper weighting, it is possible for Applicant to "tune" the barrel to hit a "sweet spot" at a given, fixed distance. The "sweet spot" is achieved when the barrel design produces shot groups at which the trajectories of a series of bullets discharged from the muzzle of the rifle held in a stationary position exhibit a minimum deviation at the given, fixed distance. This would be for 5 ounces of added weight for the 6 mm Remington™ rifle discussed above.

Applicant's inventive method also provides a technique for decreasing the "positive compensation" achieved by the barrel design to compensate for varying velocity ammunition or for shooting at shorter distances than the design distance of the barrel. This is accomplished, in part, by extending the rifle action with a tensioning bar (39 in FIGS. 2 and 5) which is welded to a front face of the recoil lug 27. The tensioning bar extends in a generally horizontal plane outwardly from the recoil lug in the direction that the barrel extends longitudinally. In the example shown, the tensioning bar is about ⅜ inches wide and tall by about 3 to 5 inches in length. The length is not particularly critical. The tensioning bar is received within a longitudinal slot 41 provided in the forearm of the stock. The slot 41 is approximately centrally located in the stock recess 19.

Tension on the tensioning bar is adjusted by providing an adjustment knob 43 which extends vertically downward from the rifle forearm at one extent and which contacts the tensioning bar at an opposite extent. In the example illustrated, the adjustment knob is a simple screw mechanism received within a threaded bore in the stock forearm. A spring can also be placed between the length of the threaded screw and the tensioning bar to provide a finer degree of tuning. Turning the adjustment knob inwardly exerts a force on the tensioning bar, thereby restricting the tendency of the action to lift up out of the stock recess under recoil. In this way, the tensioning bar 39 and adjustment knob 43 can be used to control the vertical bending and upswing of the rifle barrel under recoil so as to converge velocity to a given fixed distance.

In other words, adjusting the tension on the tensioning bar with the adjustment knob acts to restrict movement of the action/receiver and, in turn, upward force on the barrel acting to lift the barrel upward from the stock recess, thereby reducing the vertical whipping action of the barrel at shorter shooting distances or to compensate for variances in ammunition velocity. In this way, ammunition with varying velocities will hit the same "sweet spot" on a target at the given fixed distance. The tensioning bar and adjustment knob can be incrementally adjusted to vary any muzzle weighted effect produced by the barrel design when shooting at shorter distances or when there is a velocity variance in the ammunition being used in the rifle.

Figure 7:
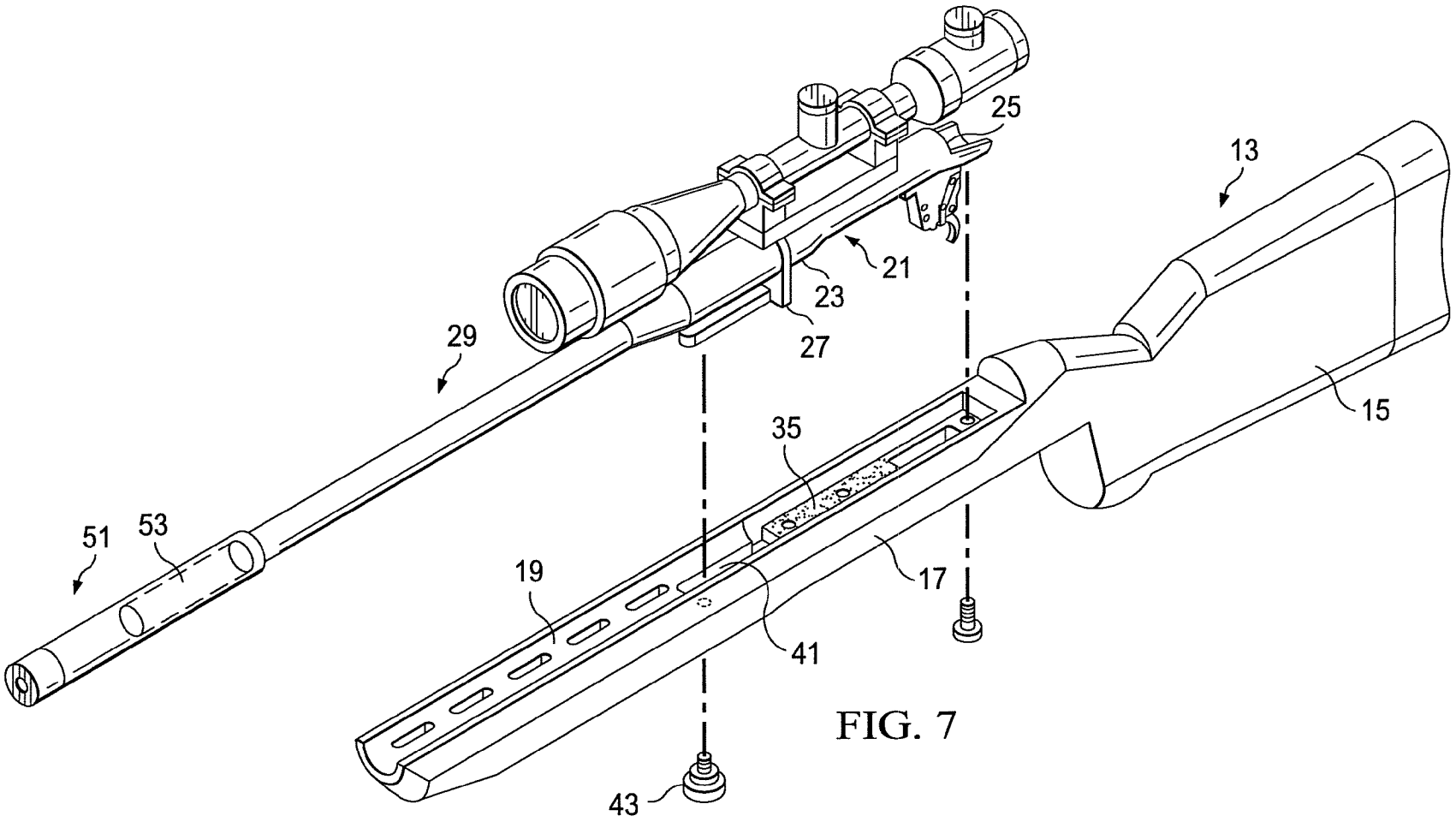
FIG. 7 is view similar to FIG. 3, but showing a highly accurate rifle design of the invention which also features the noise suppressor of the invention.
Figure 8:
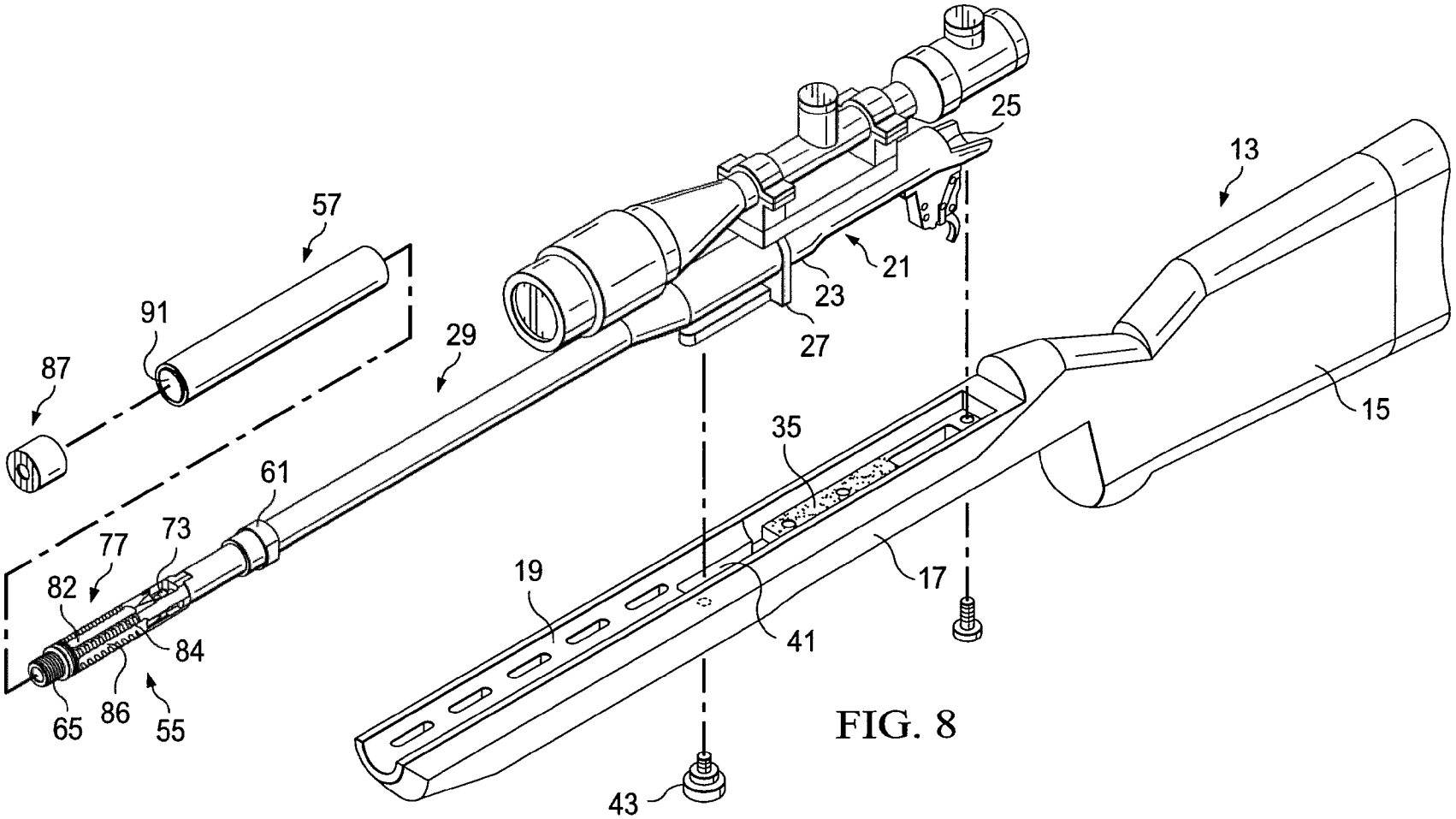
FIG. 8 is a view similar to FIG. 3, with the suppressor being shown with the inner core component being mounted on the rifle barrel and the outer sleeve being shown in exploded fashion.
Figure 9:
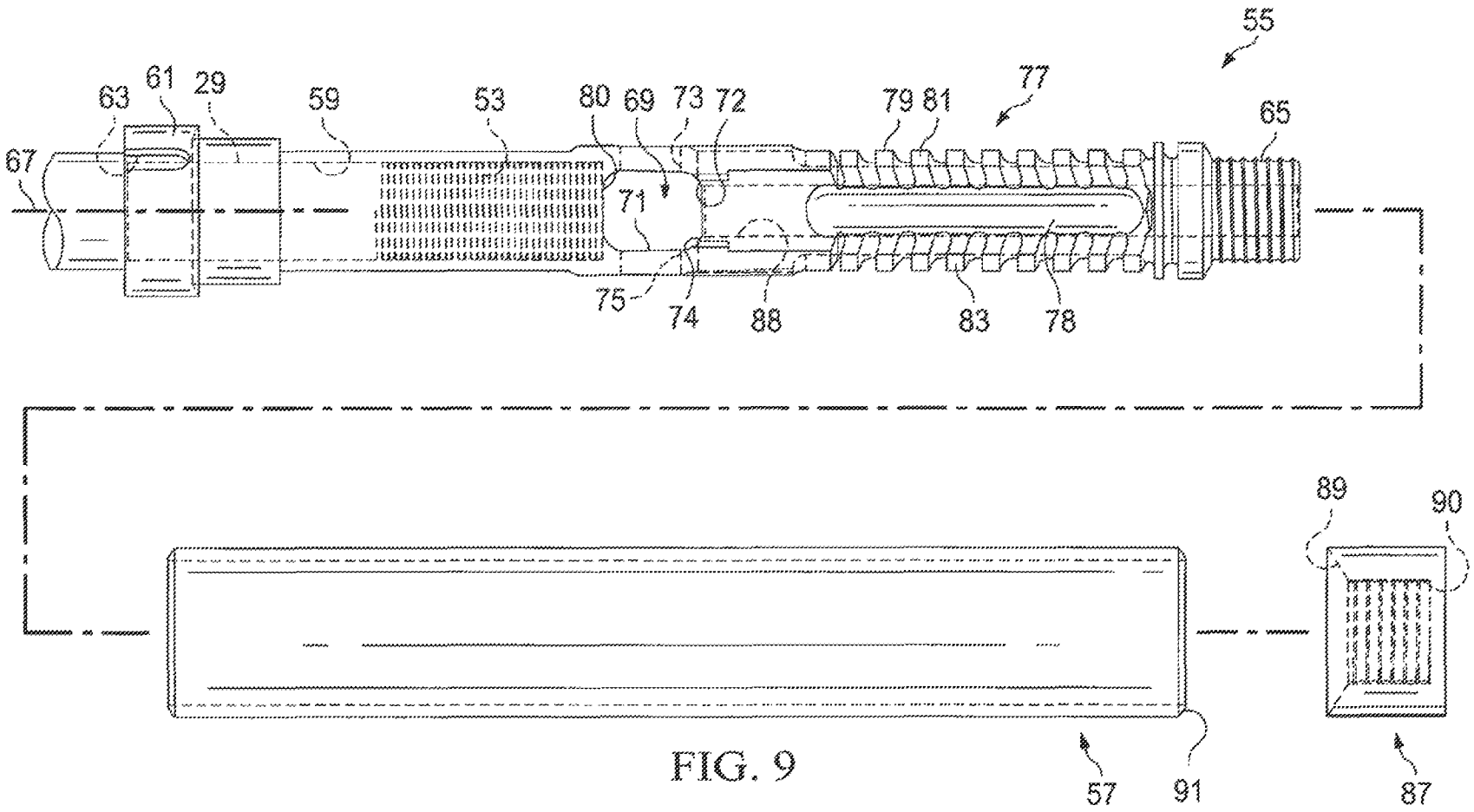
FIG. 9 is an isolated, exploded view of the noise suppressor of the invention.

The Noise Suppressor System:

The noise suppressor system of the invention will now be described. Although the noise suppressor (shown at 51 in FIG. 7) will be described with reference to the highly accurate rifle design shown in FIGS. 1-6, it will be understood that it could be adapted to other rifle designs, as well. With reference to FIGS. 8 and 9, the noise suppressor 51 is installed on a rifle having a barrel 29 at a breach end, the rifle having an externally threaded distal end (generally shown by the dotted lines 53 in FIG. 7). The noise suppressor has an inner core component 55 and an outer sleeve component 57. The outer sleeve component 57 is closely received about the inner core component 55 in use, as can be seen in FIG. 7. The inner core component is preferably of a one piece design, formed of a single piece of metal.

With reference to FIG. 9, it can be seen that the inner core component 55 has an internally threaded, barrel receiving end 59 which receives and engages the exteriorly threaded end 53 of the rifle barrel in overlapping fashion. The barrel receiving end of the inner core component can be provided with a lug region 61 provided with one or more flats, such as flat 63, for engaging an assembly wrench or tool (not shown).

The inner core component also has an oppositely arranged exteriorly threaded end 65. A central bore 67 extends between the two ends of the core component and is aligned in use to a high degree of accuracy with the center bore of the rifle barrel at all times. As will understood by those skilled in the relevant shooting arts, firing of a bullet though the rifle barrel sets off hot exhaust gases in the central bore 67.

The sleeve component 57 forms a surrounding outer chamber between the sleeve component 57 and the inner core component 55 when the sleeve is in place on the inner core component. The chamber would generally exist along the length of the outer diameter of the inner core component between the lug region 61 and the threaded end 65. As can be seen in FIG. 9, the inner core component 55 also has an inner chamber 69 with at least one pair of oppositely facing window openings (such as opening 71) for exhausting gases from the inner chamber into the surrounding outer chamber. Preferably, the chamber 69 also has top and bottom openings 73, 75.

As best seen in FIG. 9, the inner core component 55 also has an exterior longitudinal region 77 forward of the central chamber 69. The exterior region 77 has a series of longitudinally aligned, upwardly extending teeth or facets (such as teeth 79, 81) formed therein on a specially profiled outer longitudinal surface 78 for diverting the hot, high speed gases contacting the upwardly extending teeth. The longitudinally aligned teeth 79, 81, on the longitudinal region 77 of the suppressor define a series of teeth crests separated by a series of troughs. It can be seen in FIG. 9 that the crests 83 of the longitudinally aligned teeth are inclined slightly in the direction of the central chamber 69 and the direction of the hot gases being exhausted therein. In the preferred version of the invention shown, there are two generally parallel rows of teeth (such as rows 82, 84 in FIG. 8) on a top surface of the longitudinal region 77 and two oppositely arranged parallel rows of teeth (such as row 86 which is visible in FIG. 8) on a bottom surface of the longitudinal region 77.

It will also be appreciated from FIG. 9 that the central bore 67 of the suppressor feeds into the central chamber and then into a continuation bore 88. The continuation bore 88 has a bore opening which is defined by a chamfered region (generally at 72, 74 in FIG 9). It can be seen in FIG. 9 that the rifle crown (generally at 80) abuts the central chamber 69 and, in fact, may protrude about 0.020 inches into the chamber opening. By protruding slightly into the chamber, high speed gases are deflected off the thread area, which reduces carbon build up in the threads which could cause galling of the threads upon removal. It is also important to note that the width of the window opening 71 and the spacing of the rifle crown 80 from the continuation bore 88 are intentionally sized, so that a bullet exiting the rifle barrel 29 enters the continuation of the suppressor bore 88 before the bullet completely exists the crown of the rifle barrel. Preferably, approximately one fourth of the bullet enters the continuation bore 88 before it completely exists the rifle barrel bore.

This "deep hole" technology can help to stabilize a balloting or wobbling bullet as it exits the rifle muzzle and passes on to the continuation bore 88. The flow of hot gases around the bullet in the central chamber contacts the chamfered region 72, 74 and causes an effect which may be analogized to that of a "venturi" effect which straightens the bullet path out. This feature eliminates the need for specific bullet seating depth calculations intended to compensate for variations in bullet seating depth due to the throat melting forward in normal use.

The internally threaded, barrel receiving end of the inner core component 55, which receives and engages the exteriorly threaded end of the rifle, together with the oppositely arranged exteriorly threaded end 65, together provide a "two-point mount" for the noise suppressor on the rifle barrel. This is accomplished by the engagement of the core component internally threaded end with the exterior threads 53 of the rifle barrel at one extent and by the engagement of a threaded end cap (87 in FIG. 9) which engages the exteriorly threaded end 65 of the inner core component at an opposite extent to complete the two-point mount.

As shown in FIG. 9, he preferred end cap 87 has an internal bevel 89 which matches the contour of an external bevel 91 provided on outer sleeve 57 when the internal threads 90 of the threaded end cap is engaged with the exteriorly threaded end 65 of the inner core component.

The particular arrangement of the internal and external chambers of the noise suppressor, together with the window openings and specially profiled outer longitudinal surface 78 surprisingly create a self-cleaning design.

While not wishing to be held to any particular theory, the presence of the teeth or facets on the outer longitudinal surface 78 of the inner core component, rather than using round discs, is thought to play an important role in achieving the cleaning effect. The gas velocity is being increased within the "can" defined by the inner core component and outer sleeve. The teeth or fins divert high speed air which further increases the velocity. By its nature, the suppressor reduces air pressure by its internal volume while the velocity is kept high for the cleaning effect.

While the noise suppressor of the invention could be used with various rifle designs, it can also advantageously be used with the highly accurate rifle design previously described. In other words, the noise suppressor adds weight forward of the crown of the rifle muzzle, the added weight being proportional to a desired tuning effect at a longest expected shooting distance, for positively compensating the rifle for slower bullet velocities. The effect of the added weight forward of the barrel crown would be the same as has previously described with respect to FIGS. 1-6. Thus, a rifle design can be provided with a solid bull muzzle end with a recessed crown and wherein the barrel weight which exists in front of the recessed crown is in tune for one specific distance only, the barrel also having a narrowed mid-section which produces an increased whippy vertical bending action under recoil and a thus a wider tune spectrum on the vertical upswing of the barrel under recoil, the barrel being characterized as having an infinitely tunable positive compensation.

An invention has been provided with several advantages. The rifle design of the invention intentionally creates more rifle bending with the bending then being controlled by restricting the specific weight in front of the crown with a particular type of adjustment mechanism. The barrel being tuned for one distance only. Applicant's design intentionally creates a large positive compensation due to the barrel contour and weighting with an exaggerated "whippy" vertical bending under recoil. The result is a wider tune spectrum upon upswing of the barrel as compared to systems which are tying to "dampen" vibrations in the rifle barrel. The stock tension device, in simple terms, acts as a sort of switch to turn the muzzle weighted effect off or partially off by incremental movement of the adjustment knob. Once the rifle is calibrated, if a velocity variance in ammunition is detected, the convergence point of the bullet can be adjusted. The barrel is cut and weighted for the longest expected shooting distance with the tensioning adjustment being used for adjustments when shooting shorter distances or in varying atmospheric conditions.

The noise suppressor of the invention can be used with the highly accurate rifle design described, or with other rifle designs. The suppressor overlaps the threaded rifle barrel and is engaged by a two-point mount. The suppressor proportions weight in front of the barrel crown for tuning. The specially designed chambers and windows allow gases in the central chamber to pass around the inner core component, allowing gases to flow forward and backward. The design helps to eliminate turbulence in the bullet's flight path. The flow of the high velocity gases in the central chamber helps to stabilize a yawing bullet resulting from bore yaw. The teeth or facets on the exterior surface of the inner core component are self-cleaning. The design eliminates the need for O-rings or internal baffles which can wear with use. The one-piece design is sturdy and strong.

While the invention has been shown in only two of its forms, it is not thus limited and is susceptible to various changes and modifications without departing from the spirit thereof.

I claim:

1. A noise suppressor for a rifle having a barrel at a breach end, the barrel also having an externally threaded, distal end terminating in a rifle crown, the noise suppressor comprising:

an inner core component and an outer sleeve component, the outer sleeve component being closely received about the inner core component in use;

wherein the inner core component has an internally threaded, barrel receiving end which receives and engages the exteriorly threaded end of the rifle barrel in overlapping fashion, an oppositely arranged exteriorly threaded end, and a central bore between the two ends which allows the passage of a bullet when the bullet is fired, firing of the bullet also setting off hot, high speed exhaust gases in the central bore;

wherein the sleeve component forms a surrounding outer chamber between the sleeve component and the inner core component when in place on the inner core component, the inner core component also having a central chamber with at least one pair of oppositely facing window openings, each having a given width, for exhausting gases from the central chamber into the surrounding outer chamber;

wherein the inner core component is a one piece design, fanned of a single piece of metal, the inner core component also having an exterior longitudinal region forward of the central chamber, the exterior region having a series of longitudinally aligned, upwardly extending teeth formed therein, the teeth being formed therein only forward of the central chamber for diverting the hot, high speed gases contacting the upwardly extending teeth; and wherein the central bore of the suppressor feeds into the central chamber of the inner core component and then into a continuation bore running parallel to the exterior longitudinal region which comprises a continuous longitudinal passageway through the single piece of metal which forms a part of the central bore of the inner core component, and wherein the width of the window openings and the spacing of the rifle crown from the continuation bore are intentionally sized so that a bullet exiting the rifle barrel enters the continuation bore of the suppressor before the bullet completely exits the crown of the rifle barrel;

and wherein the continuation bore has a bore opening defined by a chamfer region around the bore opening, the chamfer region creating a venturi effect with respect to the flow of hot, high speed exhaust gases around the bullet in the central chamber as the bullet leaves the central chamber and enters the continuation bore which straightens the bullet path.

2. The noise suppressor of claim 1, wherein the longitudinally aligned teeth on the longitudinal region of the suppressor define a series of teeth crests separated by a series of troughs.

3. The noise suppressor of claim 2, wherein the crests of the longitudinally aligned teeth are inclined slightly in the direction of the central chamber and the direction of the hot gases being exhausted therein.

4. The noise suppressor of claim 3, wherein the central chamber, in addition to the pair of oppositely arranged window openings, also has a pair of top and bottom openings for exhausting additional gases from the central chamber.

5. The noise suppressor of claim 4, wherein the internally threaded, barrel receiving end of the inner core component which receives and engages the exteriorly threaded end of the rifle, together with the oppositely arranged exteriorly threaded end, together provide a two-point mount for the noise suppressor on the rifle barrel.

6. The noise suppressor of claim 5, wherein a threaded end cap engages the exteriorly threaded end of the inner core component to complete the two-point mount.

7. The noise suppressor of claim 6, wherein the threaded end cap has an internal bevel which matches the contour of an external bevel provided on outer sleeve when the threaded end cap is engaged with the exteriorly threaded end of the inner core component.

8. The noise suppressor of claim 7, wherein the inner core component is a one piece design, formed of a single piece of metal.

9. A noise suppressed firearm having a stock with a butt end and a grip end and a forearm extending therefrom, the firearm also having a barrel with a breech providing a chamber therein defining a diameter and length of a projectile fired from the firearm, a muzzle with a crown, a bore between the breech and crown of the muzzle having a predetermined cross-sectional area, the firearm comprising:

a noise suppressor mounted on the muzzle end of the firearm barrel, the noise suppressor including:

an inner core component and an outer sleeve component, the outer sleeve component being closely received about the inner core component in use:

wherein the inner core component has an internally threaded, barrel receiving end which receives and engages the exteriorly threaded end of the rifle barrel in overlapping fashion, an oppositely arranged exteriorly threaded end, and a central bore between the two ends which allows the passage of a bullet when the bullet is fired, firing of the bullet also setting off hot, high speed exhaust gases in the central bore;

wherein the sleeve component forms a surrounding outer chamber between the sleeve component and the inner core component when in place on the inner core component, the inner core component also having a central chamber with at least one pair of oppositely facing window openings, each having a given width, for exhausting gases from the central chamber into the surrounding outer chamber;

wherein the inner core component is a one piece design, formed of a single piece of metal, the inner core component also having an exterior longitudinal region forward of the central chamber, the exterior region having a series of longitudinally aligned, upwardly extending teeth formed therein, the teeth being formed therein only forward of the central chamber for diverting the hot, high speed gases contacting the upwardly extending teeth; and wherein the central bore of the suppressor feeds into the central chamber of the inner core component and then into a continuation bore running parallel to the exterior longitudinal region which comprises a continuous longitudinal passageway through the single piece of metal which forms a part of the central bore of the inner core component, and wherein the width of the window openings and the spacing of the rifle crown from the continuation bore are intentionally sized so that a bullet exiting the rifle barrel enters the continuation bore of the suppressor before the bullet completely exits the crown of the rifle barrel;

and wherein the continuation bore has a bore opening defined by a chamfer region around the bore opening the chamfer region creating a venturi effect with respect to the flow of hot, high speed exhaust gases around the bullet in the central chamber as the bullet leaves the central chamber and enters the continuation bore which straightens the bullet path.

10. The noise suppressed firearm of claim 9, wherein the longitudinally aligned teeth on the longitudinal region of the suppressor define a series of teeth crests separated by a series of troughs.

11. The noise suppressed firearm of claim 10, wherein the crests of the longitudinally aligned teeth are inclined slightly in the direction of the central chamber and the direction of the hot gases being exhausted therein.

12. The noise suppressed firearm of claim 11, wherein the central chamber, in addition to the pair of oppositely arranged window openings, also has a pair of top and bottom openings for exhausting additional gases from the central chamber.

13. The noise suppressed firearm of claim 12, wherein the internally threaded, barrel receiving end of the inner core component which receives and engages the exteriorly threaded end of the rifle, together with the oppositely arranged exteriorly threaded end, together provide a two-point mount for the noise suppressor on the rifle barrel.

14. The noise suppressed firearm of claim 13, wherein a threaded end cap engages the exteriorly threaded end of the inner core component to complete the two-point mount.

15. The noise suppressed firearm of claim 14, wherein the threaded end cap has an internal bevel which matches the contour of an external bevel provided on outer sleeve when the threaded end cap is engaged with the exteriorly threaded end of the inner core component.

16. The noise suppressed firearm of claim 9, wherein the noise suppressor adds weight forward of the crown of the rifle muzzle, the added weight being proportional to a desired tuning effect at a longest expected shooting distance, for positively compensating the rifle for slower bullet velocities.

17. The noise suppressed firearm of claim 16, wherein the barrel has a solid bull muzzle end with a recessed crown and wherein the barrel weight which exists in front of the recessed crown is in tune for one specific distance only, the barrel also having a narrowed mid-section which produces an increased whippy vertical bending action under recoil and a thus a wider tune spectrum on the vertical upswing of the barrel under recoil, the barrel being characterized as having an infinitely tunable positive compensation.

18. The noise suppressed firearm of claim 9, wherein the noise suppressor is self-cleaning.

* * * * *